US008967970B2

(12) United States Patent
Hein et al.

(10) Patent No.: US 8,967,970 B2
(45) Date of Patent: Mar. 3, 2015

(54) FLUID PUMP

(75) Inventors: Bernd Hein, Baiersbronn/Schoenmuenzack (DE); Christoph Heier, Iffezheim (DE)

(73) Assignee: Robert Bosch GmbH, Stuttgart (DE)

( * ) Notice: Subject to any disclaimer, the term of this patent is extended or adjusted under 35 U.S.C. 154(b) by 622 days.

(21) Appl. No.: 13/389,155

(22) PCT Filed: Jul. 5, 2010

(86) PCT No.: PCT/EP2010/059522
§ 371 (c)(1),
(2), (4) Date: Apr. 17, 2012

(87) PCT Pub. No.: WO2011/015413
PCT Pub. Date: Feb. 10, 2011

(65) Prior Publication Data

US 2012/0195754 A1 Aug. 2, 2012

(30) Foreign Application Priority Data

Aug. 6, 2009 (DE) ..... 10 2009 028 310

(51) Int. Cl.
*F04D 29/046* (2006.01)
*F04D 29/02* (2006.01)
*F04D 29/047* (2006.01)

(52) U.S. Cl.
CPC ..... *F04D 29/026* (2013.01); *F04D 29/0462* (2013.01); *F04D 29/047* (2013.01)
USPC ..... 416/174; 416/146 R; 416/170 R

(58) Field of Classification Search
CPC ..... F04D 29/046; F04D 29/05; F04D 29/056; F05D 2300/509
USPC ..... 415/229; 416/174, 146 R
See application file for complete search history.

(56) References Cited

U.S. PATENT DOCUMENTS

| | | | | |
|---|---|---|---|---|
| 4,512,724 | A * | 4/1985 | Horvath | 417/319 |
| 4,722,661 | A * | 2/1988 | Mizuno | 415/131 |
| 6,264,440 | B1 * | 7/2001 | Klein et al. | 417/420 |
| 6,443,710 | B1 * | 9/2002 | Tatsukami et al. | 417/365 |
| 2001/0033800 | A1 | 10/2001 | Deai et al. | |

FOREIGN PATENT DOCUMENTS

| | | |
|---|---|---|
| DE | 3706970 | 9/1988 |
| DE | 9214418 | 5/1994 |
| GB | 979009 | 1/1965 |
| JP | 2-252998 | 10/1990 |
| JP | 2002155884 | 5/2002 |

(Continued)

OTHER PUBLICATIONS

PCT/EP2010/059522 International Search Report dated Jan. 31, 2011 (2 pages).

*Primary Examiner* — Ninh H Nguyen
(74) *Attorney, Agent, or Firm* — Michael Best & Friedrich LLP

(57) ABSTRACT

A fluid pump 1, particularly a water pump 1, wherein an impeller 11 comprising a plain bearing bush 12 is rotatably supported on a bearing pin 13. The impeller 11 and the plain bearing bush 12 are thereby made of an identical base material in one or more pieces. A further material is mixed into the base material of the plain bearing bush 12, improving the sliding properties of the plain bearing bush 12 on the bearing pin 13.

14 Claims, 2 Drawing Sheets

(56) References Cited

FOREIGN PATENT DOCUMENTS

| | | |
|---|---|---|
| JP | 2006-9819 | 1/2006 |
| JP | 2006316652 | 11/2006 |
| JP | 2007205190 | 8/2007 |
| JP | 2007205246 | 8/2007 |
| JP | 2007211691 | 8/2007 |

* cited by examiner

FLUID PUMP

BACKGROUND OF THE INVENTION

The invention relates to a fluid pump and to a method for forming a fluid pump, in particular water pump, with a bearing pin on which an impeller with a plain bearing bush is rotatably mounted.

Fluid pumps, in particular water pumps, are used, for example, in motor vehicles in order to ensure circulation of a coolant. Use is made here of various designs of fluid pumps. Fluid pumps are generally formed in two parts and comprise a pumping region and a motor region. In this case, an impeller can serve as a bladed wheel for the fluid circuit and for the driving of the fluid pump. The impeller is generally formed from a plastoferrite in order to be able to have magnetic properties. The impeller is generally connected to a plain bearing bush which is formed, for example, from a briquet bonded with synthetic resin. As a result, the impeller can be used as a rotor which sits with the plain bearing bush on a bearing pin and rotates about the bearing pin.

Due to the different thermal expansion of the materials of the impeller and the plain bearing bush, cracking frequently occurs due to internal stresses in the components, and this, in turn, may lead to the component failing. Furthermore, the production of the fluid pump is time-consuming, since the plain bearing bush has to be placed in the injection molding die before the impeller can be cast over the plain bearing bush in the injection molding process.

SUMMARY OF THE INVENTION

It is the object of the invention to provide an improved fluid pump.

According to the invention, the fluid pump has a bearing pin on which an impeller with a plain bearing bush is rotatably mounted. In this case, the impeller and the plain bearing bush are formed from a basic material as a single piece or in a number of parts. Furthermore, a further material which improves the sliding properties of the plain bearing bush on the bearing pin is embedded in the basic material of the plain bearing bush.

An advantage of the fluid pump according to the invention is that the impeller and the plain bearing bush are formed from an identical basic material as a single piece or in a number of parts, and therefore have identical material properties. As a result, the impeller and the plain bearing bush have an at least similar coefficient of thermal expansion, thus enabling cracking due to internal stresses in the components to be reduced or avoided. Furthermore, the production time and the production costs can be reduced as a result, by the impeller and the plain bearing bush also being produced as a single piece in an injection molding process.

In one embodiment of the invention, a further material of the plain bearing bush comprises wax and/or carbon powder. By introduction of the further material, such as wax and/or carbon powder, into the plain bearing bush, the sliding properties on the bearing pin are improved.

In a further embodiment of the invention, the basic material contains polyamides, polyphthalamides, partially crystalline, partially aromatic polyamides or polyphenylsulfides. Said materials have a required hydrolysis resistance to the pumping medium, and therefore the material does not dissolve during use.

According to a further embodiment of the invention, the impeller contains a magnetic material. In this case, the magnetic material preferably comprises ferrite powder which is embedded into the basic material. Owing to the magnetic powder, the impeller has magnetic properties, and therefore the impeller can be used as the rotor of the fluid pump and therefore serves to transmit the magnetic forces or driving forces.

In a further embodiment of the invention, the bearing pin is formed from special steel. As a result, the bearing pin is resistant to corrosion.

Furthermore, in a further embodiment of the invention, a rinsing channel in the form of a groove is arranged in the plain bearing bush. A hydrostatic and/or hydrodynamic plain bearing can be realized with the rinsing channel. In this case, the pumping medium serves as a lubricant for the plain bearing.

In a further embodiment of the invention, a labyrinth seal is arranged on the fluid pump. Owing to the labyrinth seal, it is possible to prevent impurities which arise in the pumping region of the fluid pump from passing into the motor region of the fluid pump.

BRIEF DESCRIPTION OF THE DRAWINGS

The invention is explained in more detail below using exemplary embodiments with reference to the attached drawings. In the drawings, showing by way of example the multipiece design.

DETAILED DESCRIPTION

Figure 1:
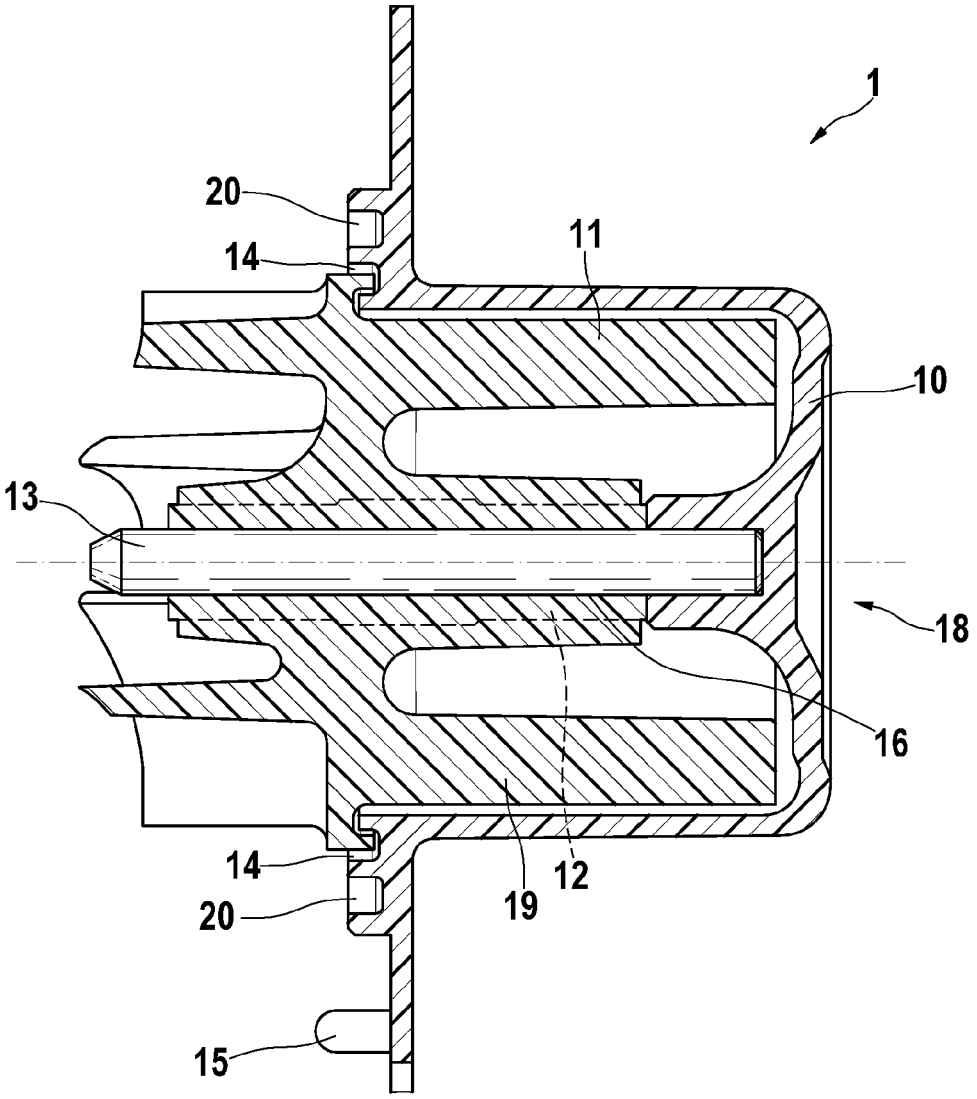
FIG. 1 shows a schematic illustration of a water pump.

FIG. 1 shows a schematic partial illustration of a fluid pump in the form of a water pump 1. The water pump 1 has a motor region 18 and a pumping region (not illustrated). The motor region 18 of the water pump 1 comprises a housing 10 of cup-shaped design. The cup-shaped housing 10 is preferably produced from a thermoplastic, such as polyphthalamides or polyphenylenesulfide, in an injection molding process.

As an alternative, the cup-shaped housing 10 may be manufactured from any other nonmagnetic material. Since the water pump 1 is driven electrically, a rotor 19 is formed within the cup-shaped housing 10 and a stator, which is not shown in the illustration, is formed outside the cup-shaped housing 10. Furthermore, the cup-shaped housing 10 has a knob 15, a labyrinth seal 14 and a bearing pin 13.

The knob 15 is arranged as an installation aid on the cup-shaped housing 10 and is used for the simple positioning of the motor region 18 on the pumping region of the water pump 1. The labyrinth seal 14 for sealing off the motor region 18 from the pumping region of the water pump 1 is formed as a recess on the cup-shaped housing 10. Since the water pump 1 is used in motor vehicles, the combustion engines of which are produced in an injection molding process, residues of molding sand may pass into the pumping medium. The molding sand may have residual magnetism which can be attracted by the rotor 19 which is of magnetic design. The labyrinth seal 14 can prevent the pumping medium, which may have a small portion of molding sand, from entering the narrow gap between the cup-shaped housing 10 and the rotor 19, which may lead to blocking of the rotor 19. In this case, the pumping medium in the water pump 1 may be a water/glycol mixture. The bearing pin 13 is made, for example, of special steel. Before the injection molding of the cup-shaped housing 10, the bearing pin is positioned centrally in the injection molding die and is subsequently insert molded with the thermoplastic of the cup-shaped housing 10. As a result, the bearing pin 13 is fastened fixedly in the cup-shaped housing 10 of the water pump 1.

An impeller 11 with a plain bearing bush 12 is mounted rotatably on the bearing pin 13 of the water pump 1. Furthermore, the impeller 11 with the plain bearing bush 12 is mounted rotatably in a recess 20 on the cup-shaped housing 10 with the aid of the bearing pin 13. The impeller 11 and the plain bearing bush 12 are formed from an identical basic material as a single piece or in a number of parts. The basic material preferably comprises polyamides (PA6), polyphthalamides (PPA), partially crystalline, partially aromatic polyamides (PA6T/6I) or polyphenylsulfides (PPS). Furthermore, the basic material has hydrolysis resistance to the pumping medium, and therefore the material does not dissolve during use. However, other hydrolysis-resistant materials can also be used as the basic material for the impeller 11 and the plain bearing bush 12.

The impeller 11 contains a magnetic material, preferably ferrite powder. The magnetic material is preferably introduced over the entire region of the impeller 11. As an alternative, other magnetic particles or magnetic materials may also be used. Owing to the magnetic powder, the impeller 11 has magnetic properties, and therefore the impeller 11 can be used as a rotor 19 of the water pump 1. Furthermore, the plain bearing bush 12 contains a further material which increases the sliding property of the plain bearing bush 12 on the bearing pin 13. In particular, the further material is embedded in the basic material in the region of a sliding surface with which the plain bearing bush 12 is mounted rotatably on the bearing pin 13. For example, wax and/or carbon powder can be used as the further material. However, in order to improve the sliding properties of the plain bearing bush 12, use may also be made of other materials which are suitable for this purpose.

The impeller 11 and the plain bearing bush 12 are produced in an injection molding process. In this case, the impeller 11 and the plain bearing bush 12 can be produced in a two-stage injection molding process. In a first injection molding operation, the plain bearing bush 12 is manufactured. In this case, a further material is mixed into the basic material, and therefore granulated material is produced for the injection molding process. The granulated material is subsequently placed in a funnel of an injection molding machine, the granulated material being drawn out of the funnel into a worm spiral, and being divided up and subjected to shearing. The resultant frictional heat in conjunction with the heat supplied by a heated cylinder ensures a relatively homogeneous melt. The melt is injected into the injection molding die under a high pressure. Before the melt of the plain bearing bush 12 fully solidifies, the impeller 11 is injected in a second injection molding operation and fused with the plain bearing bush 12, thus resulting in a single-piece component. For the granulated material of the impeller 11, the basic material is mixed here with a magnetic material. A greater or lesser amount of the further material or magnetic material can be mixed into the basic material, depending on requirements. As an alternative, the injection molding process may also proceed in a single-stage injection molding process or in a different sequence.

Between the bearing pin 13 and the plain bearing bush 12 there is a narrow sliding fit 16 which ensures a minimum bearing play. The narrow sliding fit 16 has a thickness of up to 0.08 mm over the entire sliding surface, and, as a result, impurities cannot enter between the plain bearing bush 12 and the bearing pin 13. Furthermore, the narrow sliding fit 16 avoids increased wear due to molding sand penetrating with simultaneous lubrication by wetting with pumping medium.

Figure 2:
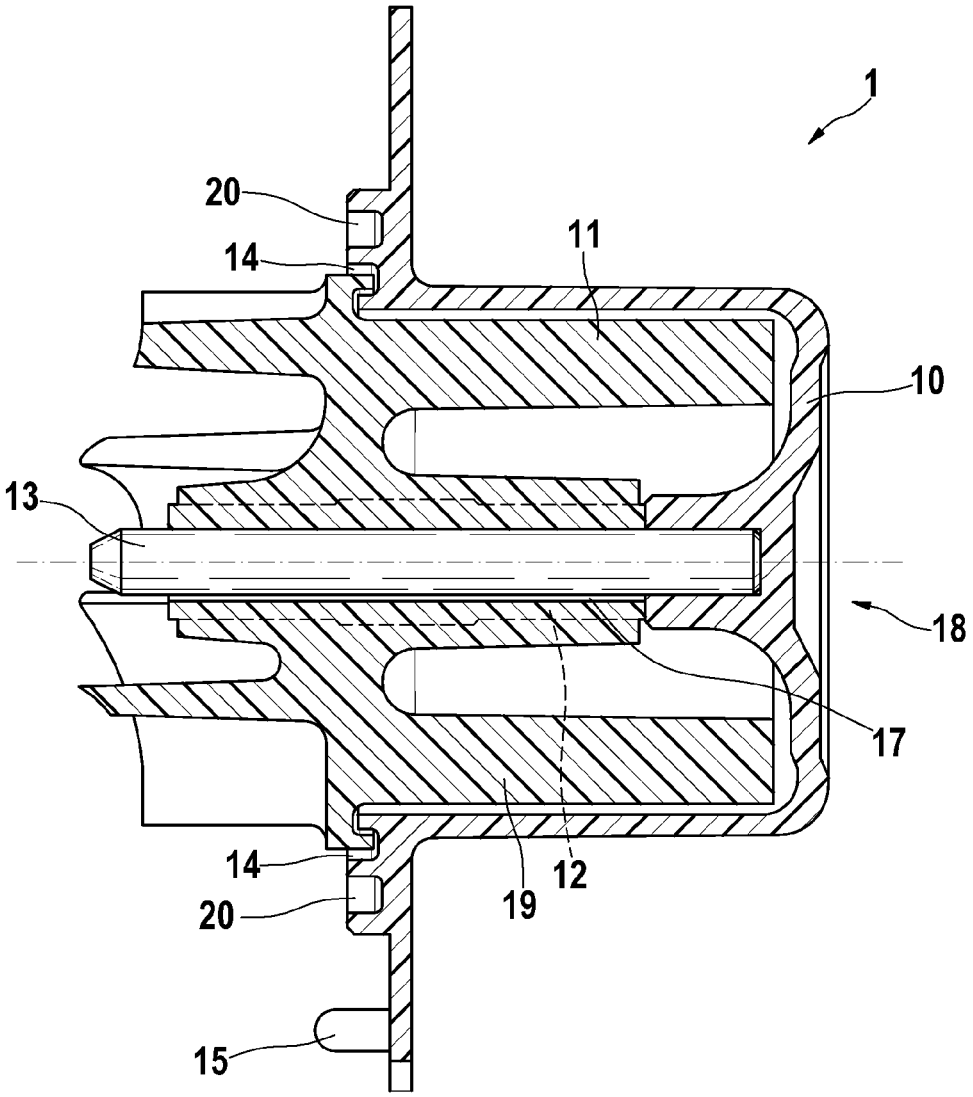
FIG. 2 shows a schematic illustration of a water pump as in FIG. 1 with a rinsing channel.

In addition to the narrow sliding fit 16, there can also be a rinsing channel 17, as shown in FIG. 2. The rinsing channel 17 is arranged in the form of a groove in the plain bearing bush 12 so that pumping media or cooling water can flow into the plain bearing. A hydrostatic and/or hydrodynamic plain bearing can be realized with the rinsing channel 17, with it being possible for the pumping medium to be used as a lubricant for the plain bearing. This is especially advantageous with a relatively clean pumping medium. Furthermore, owing to the rinsing channel 17, the impeller 11 can be mounted with the plain bearing bush 12 on the bearing pin 13 in a floating manner. This considerably reduces the friction in the bearing.

The invention is illustrated using the example of a water pump 1. However, the invention can also be used for other fluid pumps with a different pumping medium. It is advantageous in this case for the impeller 11 and the plain bearing bush 12 to be formed from an identical basic material as a single piece or in a number of parts. As a result, the impeller 11 and the plain bearing bush 12 have approximately identical material properties, thus enabling cracking due to internal stresses in the components to be avoided. Furthermore, the impeller 11 and the plain bearing bush 12 are formed from a hydrolysis-resistant material. As an alternative, different basic materials can also be used for the plain bearing bush 12 and the impeller 11, which are produced in an injection molding process. However, the different basic materials have a similar coefficient of thermal expansion, and therefore cracking due to internal stresses in the components can be avoided.

The invention claimed is:

1. A fluid pump, with a bearing pin (13) on which an impeller (11) with a plain bearing bush (12) is rotatably mounted, characterized in that the impeller (11) and the plain bearing bush (12) are formed from at least one basic material as a single piece or in a number of parts, a further material which improves the sliding properties of the plain bearing bush (12) on the bearing pin (13) being embedded in the basic material of the plain bearing bush (12).

2. The fluid pump as claimed in claim 1, characterized in that the further material comprises wax and/or carbon powder.

3. The fluid pump as claimed in claim 1, characterized in that the basic material contains polyamides, polyphthalamides, partially crystalline, partially aromatic polyamides or polyphenylsulfides.

4. The fluid pump as claimed in claim 1, characterized in that the impeller (11) contains a magnetic material.

5. The fluid pump as claimed in claim 1, characterized in that the bearing pin (13) is formed from special steel.

6. The fluid pump as claimed in claim 1, characterized in that a rinsing channel (17) in the form of a groove is arranged in the plain bearing bush (12).

7. The fluid pump as claimed in claim 1, characterized in that a labyrinth seal (14) is arranged on the fluid pump (1).

8. The fluid pump as claimed in claim 1, characterized in that the impeller (11) contains ferrite powder.

9. A method for forming a rotor of a fluid pump, with a bearing pin (13) on which an impeller (11) with a plain bearing bush (12) is rotatably mounted, the method comprising forming the impeller (11) and the plain bearing bush (12) from an identical basic material as a single piece or in a number of parts, and mixing a further material which improves the sliding properties of the plain bearing bush (12) on the bearing pin (13) into the basic material of the plain bearing bush (12).

10. The method as claimed in claim 9, characterized by producing the impeller (11) and the plain bearing bush (12) in an injection molding process.

11. The method as claimed in claim 9, characterized in that wax and/or carbon powder are/is used as the further material.

12. The method as claimed in claim 9, characterized in that polyamides, partially crystalline, partially aromatic polyamides or polyphenylsulfides are used as the basic material.

13. The method as claimed in claim 9, characterized by embedding a magnetic material, into the basic material of the impeller (11).

14. The method as claimed in claim 8, characterized by embedding ferrite powder into the basic material of the impeller (11).

* * * * *